United States Patent [19]

Weldele

[11] Patent Number: 4,626,012

[45] Date of Patent: Dec. 2, 1986

[54] LOAD POSITIONER

[76] Inventor: Gary Weldele, 2024 Britian Dr., Long Beach, Calif. 90810

[21] Appl. No.: 651,930

[22] Filed: Sep. 19, 1984

[51] Int. Cl.[4] ..... B66C 1/10

[52] U.S. Cl. ..... 294/81.3; 294/69.1; 294/67.21

[58] Field of Search ..... 294/82.12, 81.3, 81.52, 294/81.61, 82.11, 67.1, 68.1, 67.21, 904

[56] References Cited

U.S. PATENT DOCUMENTS

| | | | |
|---|---|---|---|
| 1,649,364 | 11/1927 | Peterson . | |
| 2,412,488 | 12/1946 | Austin . | |
| 3,433,459 | 3/1969 | Logan | 294/81.3 |
| 3,751,097 | 8/1973 | Jones et al. . | |
| 4,139,179 | 2/1979 | Kukulaki . | |
| 4,355,832 | 10/1982 | Andersen | 294/81.3 |
| 4,431,223 | 2/1984 | Miller . | |

*Primary Examiner*—James B. Marbert

[57] ABSTRACT

A device for lifting and tilting an object in one plane alone or in two planes simultaneously is described. The device for tilting an object in one plane comprises a rectangular frame with two end blocks and a carriage with wheels contained inside the frame. The carriage has a threaded hole to receive a threaded rod also located inside the frame with the rod extending through the end blocks. A crank on one end when turned moves the carriage in the frame. An eyebolt on the carriage is hooked to a hoisting chain and the lifting means is attached to both the end blocks and the object to be lifted. When the object is lifted, and the crank is turned, the center of gravity is moved away from being concentric with the hoisting chain and the object is tilted.

When it is desired to tilt the object in two planes, the second plane being orthogonal to the first, the device as described above is used for tilting in the first plane and a rectangular member being in the second plane is slid through an opening in the carriage to offset the center of gravity from aligning with the hoisting chain and tilt the load in the second plane. The dual plane load positioner also has a chain or cable attached to each end of the rectangular member. The cable or chain is threaded through a lockable pulley which is attached to the lower end of the hoisting chain. The dual load positioner can thereby tilt a load in two planes simultaneously. Depending on the amount of tilt in each plane, the dual load positioner can lift an object through any restricted access hole that the object can conceivably pass through.

14 Claims, 11 Drawing Figures

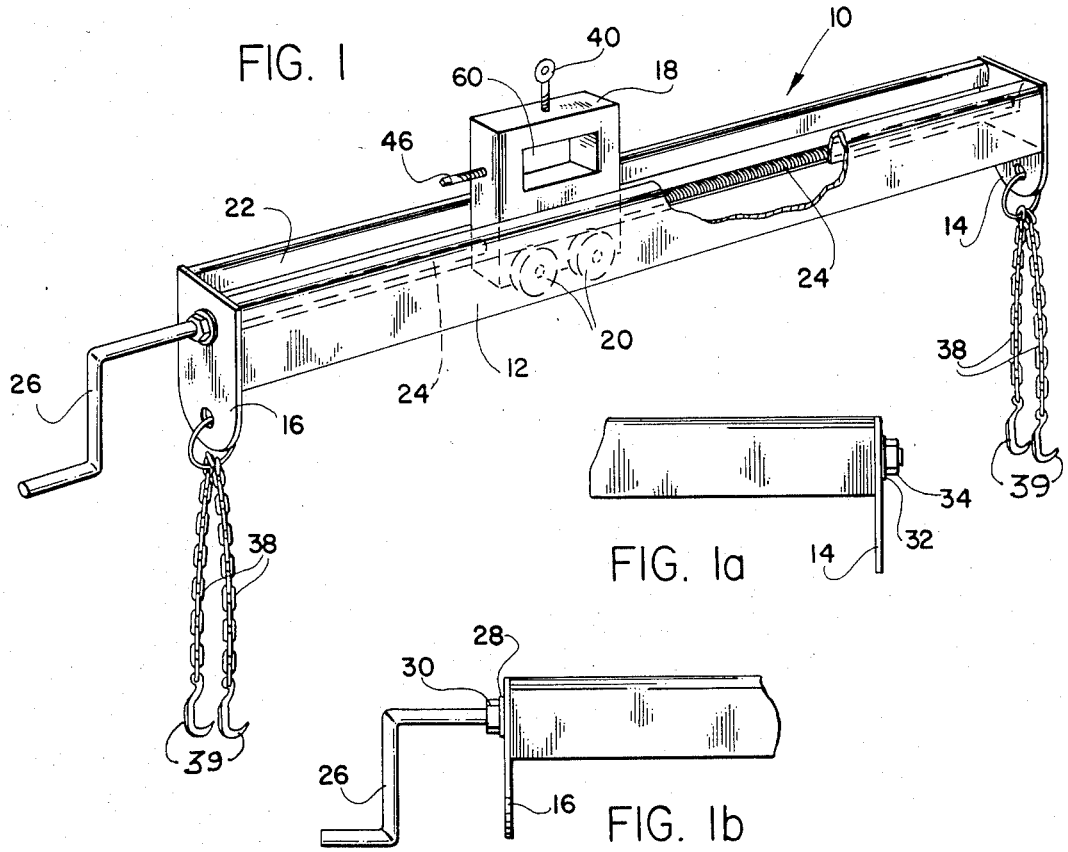
FIG. 1
10
40
60
18
46
22
14
24
20
12
24
26
16
38
39
38
39
FIG. 1a
34
32
14
28
30
26
16
FIG. 1b
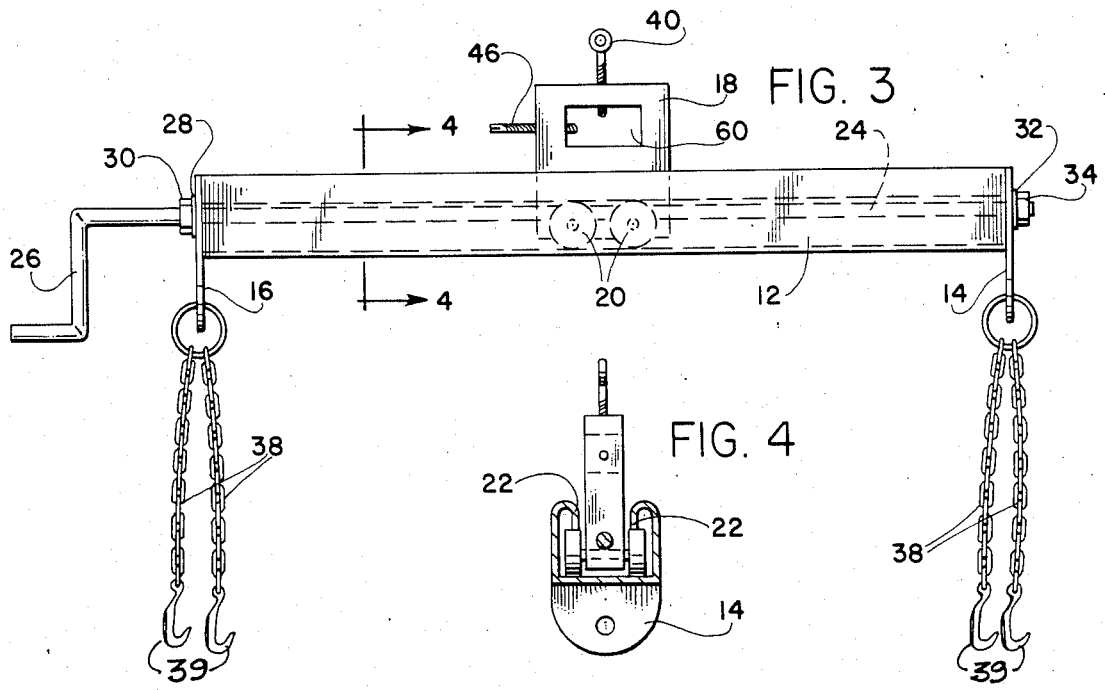
40
46
18
FIG. 3
4
60
24
32
28
30
34
26
16
4
20
12
14
38
39
FIG. 4
22
22
14
38
39

FIG. 2
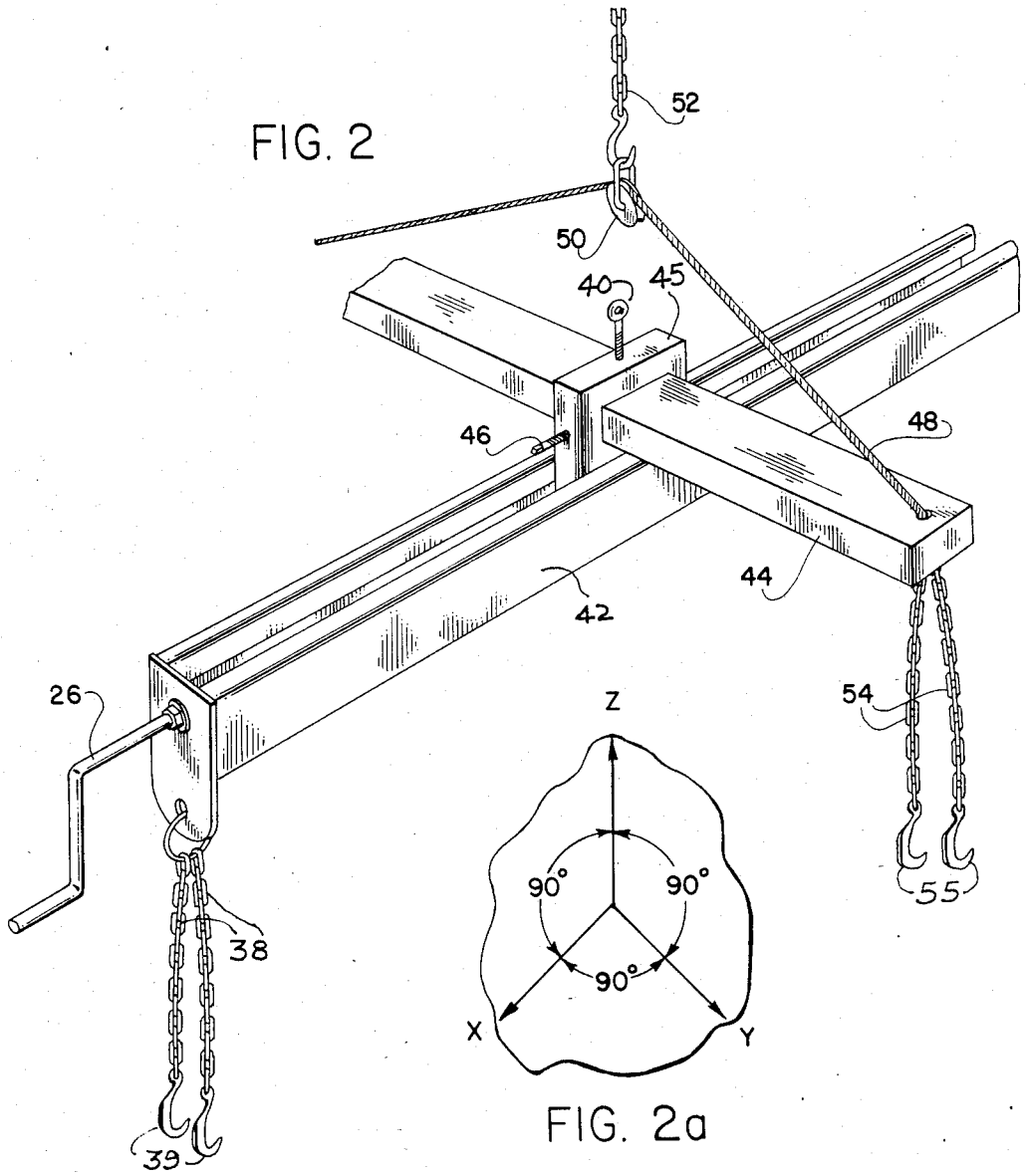
FIG. 2a
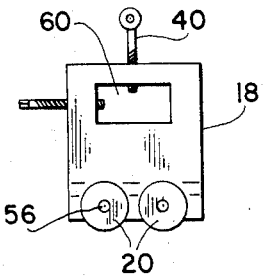
FIG. 5
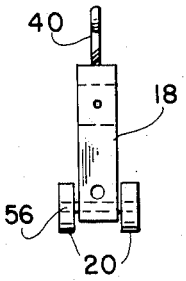
FIG. 6
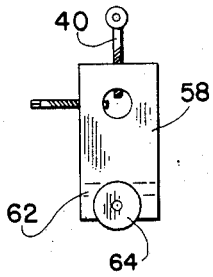
FIG. 7
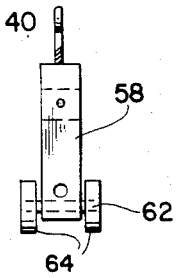
FIG. 8

LOAD POSITIONER

BACKGROUND OF THE INVENTION (a) Field of the Invention

The present invention relates in general to a lifting device and more particularly to a device that will lift and tilt an object in a single plane alone or in two planes simultaneously.

(b) Description of the Prior Art

Lifting devices or hoists that can be adjsted to tilt a load have been well known in the art. As an example, U.S. Pat. No. 1,649,364 to Peterson reveals a body hoist used by undertakers in the 1920's to tilt a corpse. More recently U.S. Pat. No. 2,412,488 to Austin describes an engine lifting harness that contains a tilting device. Also U.S. Pat. No. 3,751,097 to Jones et al describes another adjustable engine lift and U.S. Pat. No. 4,431,223 describes an engine lift tool. All of these devices tilt a load in a single plane. The present invention is capable of tilting a load in a single plane or in the orthogonal plane simultaneously. The present invention is not directed soley to lifting a engine. On the contrary, the present invention can lift a load out of a tight place, such as equipment aboard ships or submarines, which heretofore would involve two or more cranes simultaneously. This operation while being costly is also dangerous in that an excessive amount of equipment is crowded into a small space. Many times generators and electrical platforms, air compressors and associated equipment are not balanced at their lifting points, for example, when part of the equipment has been removed from the equipment platform. The present invention can be adjusted such that any unbalanced equipment can be made to lie perfectly level when hoisting the equipment and when loading, for example, on the flatbed of a truck.

There are no known devices that can adjust a load in two planes simultaneously and therefore there exists a long felt need.

SUMMARY OF THE INVENTION

It is, therefore, an object of the present invention to provide a load positioner that can incrementally tilt a load in a single plane.

It is another object of the present invention to provide a load positioner that can tilt a load in two planes simultaneously located 90 degrees to each other.

It is yet another object of the present invention to be able to lift a complex unbalanced load in a level position.

Brifly, in accordance with the invention there is provided a load positioner than can mechanically adjust a load to tilt when required to clear an obstacle in the load path. The load positioner can tilt a load in two planes simultaneously, if desired, that are 90 degrees to each other. The load positioner can also be used to balance an unbalanced load to allow a level delivery of the load to a level platform.

The novel features which are believed to be characteristics of the invention, both as its organization and its method of operation, together with further objects and advantages thereof, will be better understood from the following description in connectiion with the accompanying drawings in which a presently preferred embodiment of the invention is illustrated by way of example. It is to be expressly understood, however, that the drawings are for purposes of illustration and description only, and are not intended as a definition of the limits of the invention.

BRIEF DESCRIPTION OF THE DRAWINGS

FIG. 1 is a perspective view of the load positioner that will tilt a load in the X-Z plane.

FIGS. 1*a* and 1*b* show the end details of the load positioner shown in FIG. 1.

FIG. 2 is a partial perspective view of the load positioner that will tilt a load in both the X-Z plane and the Y-Z plane.

FIG. 2*a* is a diagram showing the orientation of the X-Z plane and Y-Z plane.

FIG. 3 is a side view of the load positioner shown in FIG. 1.

FIG. 4 is a cross section view of the load positioner of FIG. 3.

FIGS. 5 and 6 are side and end views respectively of a four wheel carriage.

FIGS. 7 and 8 are side and end views respectively of a two wheel carriage.

While the invention will be described in connection with the preferred embodiments, it will be understood that it is not intended to limit the invention to those embodiments. On the contrary, it is intended to cover all alternatives, modifications, and equivalents that may be included within the spirit and scope of the invention as described by appended claims.

DETAILED DESCRIPTION OF A PREFERRED EMBODIMENT

Referring now to FIG. 1, there is shown a load coupler generally shown as 10 with longitudinal rectangular frame 12 with end blocks 14 and 16 attached to each end of the frame 12. A carriage 18 containing wheels 20 is positioned inside of the rectangular frame 12. The rectangular frame contains a lip 22 on each side curling inward at the top to prevent the carriage 18 from being lifted out of the top of the frame 12. A threaded rod 24 extends through threads cut into carriage 18 and holes in end blocks 14 and 16. The holes in end blocks 14 and 16 are not threaded to allow the threaded rod 24 to turn freely. A crank 26 is fitted to one end of threaded rod 24 to allow the threaded rod to be turned. FIG. 1*b* shows the details of the crank end thrust washer 28 and lock nut 30 located on the outside of end block 16 that secures one end of the threaded rod 24 in rectangular member 12. FIG. 1*b*, which is opposite the crank end, shows the details of the thrust washer 32 and lock nut 34 located on the outside of end block 14 that secure the other end of the threaded rod 24 in rectangular member 12. Attached to end members 14 and 16 are lifting means which in the preferred embodiment are chains 36 of sufficient strength to hold the required load. Carriage 18 contains hoisting means which in the preferred embodiment is a eyebolt 40. A crane, winch or some other powered hoisting device powers a hoisting chain (not shown) which is attached to eye bolt 40 in FIG. 1. This powered hoisting chain can lift the object either up or down. If the object requires tilting in order to be removed from a tight access hole, the crank 26 is turned until the center of gravity of the object moves away from being concentric with the hoisting chain and the tilting is sufficient for the object to be lift out of the access hole.

Referring now to FIG. 2, there is shown two ends of a dual load positioner that can tilt a load simultaneously in two planes when the planes are orthogonally located to each other. The orientation of these planes with respect to FIG. 2 is presented in FIG. 2*a*. The X axis is parallel to first longitudinal rectangular member 42, the Y axis is parallel to second longitudinal rectangular member 44 and the Z axis is parallel to hoisting chain 52. The description of the load positioner which will hoist in the X-Z plane is identical to the one described in FIG. 1. Referring now to the dual load positioner, FIG. 2, a second longitudinal rectangular member 44 is slidably positioned through hole 60 inside of carriage 18, as shown in FIG. 1. Set screw 46 securely holds the rectangular member 44 in position when the set screw 46 is tightened. A cable or chain 48 which is attached to each end of rectangular member 44 is fitted through a pulley 50. A hoisting chain 52 is attached at its lower end to pulley 50. The pulley 50 which also contains a friction lock (not shown) can be adjusted and locked in place thereby allowing the load to be tilted. While a pulley and cable is the simplest and least expensive device, a chain and a pulley designed to accept the links in the chain, as teeth on a gear, could also be used. As can be seen, the device as described in FIG. 2 allows a load to be tilted in the X-Z plane and the Y-Z plane simultaneously. Attached to each end of rectangular member 44 are lifting means which in the preferred embodiment are chains 54.

FIG. 3 shows a side view of the load positioner as seen in FIG. 1. FIG. 4 is a cross section view of the rectangular member 12 of FIG. 1. As can be seen, the top half of rectangular member 12 is curled inward to provide strength and also prevent the wheels 20 from being lifted out of the member 12.

FIGS. 5 and 6 show the side view and end view of carriage 18. Wheels 20 are fitted to an axel 56 as shown in FIG. 6.

FIGS. 7 and 8 show a single wheel carriage 58 which can be used on light duty load positioners. The single wheel 64 is joined by axel 62. It is noted that a circular longitudinal member is substituted for the rectangular member when using single wheel carriage 58.

The load positioner 10 is manufactured by first placing the carriage 18 in the rectangular member 12 and fastening the end blocks 14 and 16, preferably by welding, to rectangular member 12. The threaded member 24 is threaded through carriage 18 and the threaded member 24 is secured outside of end members 14 and 16 by thrust washers and lock nuts 32 and 34 and 28 and 30 respectively. Chains 38 are then attached to end blocks 14 and 16 which configures the load position in the X-Z plane.

If the embodiment is desired for the X-Z and Y-Z planes, member 44 is slid through rectangular opening 60 in carriage 18 to the desired position and set screw 46 is thereby tightened. Cable or chain 48 is threaded through pulley 50 and attached to both ends of rectangular member 44. Hoist chain 52 is hooked to the entire combination and readied for hoisting. If the load (not shown) is desired to be tilted in the X-Z plane, crank 26 is turned until the desired amount of tilting is obtained. If the load is desired to be simultaneously tilted in the Y-Z plane, then member 44 is moved through opening 60 until the desired amount of tilt in the Y-Z plane is reached. Set screw 46 is then tightened to keep member 44 from moving and the friction lock (not shown) in pulley 50 is tightened to keep the pulley from turning and keep the tilt in the Y-Z plane constant.

The above load positioners as shown in FIGS. 1 and 2 can be used when lifting a platform at its lifting points when the platform is no longer balanced for some reason and the platform must be kept substantially level. This leveling of the load could be required when lifting a load out of a ship's hole to a flatbed truck or vice versa.

The operation of the load positioner as described in FIGS. 1 and 2 is essentially the same. If the device as shown in FIG. 1 is used, chains 38 are secured to the object (not shown), preferably with hooks 39. A hoisting chain is then attached to eye bolt 40 and the object is lifted slightly until the object is freely suspended. Crank 26 is then turned until the object is tilted in the required direction with the required amount of tilt. The hoisting chain is moved and the object is lifted clear of any obstruction. The procedure is reversed if the object is lowered to an area where tilting is required to obtain access.

Referring to the dual load positioner as designd by FIG. 2, chains 54 and 38 with hooks 39 and 55 are secured to the object to be lifted. If tilting is necessary in two directions to pass the object through a restricted opening, crank 26 is turned until the center of gravity of the object is offset from the hoisting chain line and the object is tilted as required. The rectangular member 44 is then moved in carriage hole 60 until the center of gravity of the object is offset from the hoisting chain sufficient to tilt the object the required amount to allow the object to clear an obstruction in two directions. Once the required tilt is obtained, the set screw 46 is tightened to lock the rectangular member 44 in place. In addition, the pulley 50 is locked by a friction lock to keep the member 44 at a constant tilt angle. The hoisting chain is then activated and the object is lifted clear of any obstruction. The procedure is reversed if the object is lowered to clear an obstacle on two sides of a restricted opening.

Thus, it is apparent that there has been provided, in accordance with the invention, a load positioner that fully satisfies the objectives, aims, and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives, modifications, and varations that fall within the spirit and scope of the appended claims.

What is claimed is:

1. A device for lifting and tilting an object in a first single plane and a second single plane orthogonal to the first single plane simultaneously comprising:

a first longitudinal rectangular member having two ends and an open top;

end blocks attached to each end of said first member with holes therethrough;

a movable carriage having threads therethrough positioned inside of said first member;

a threaded rod having two ends extending through said threaded carriage and through said holes in said end blocks to move said carriage in said first member;

a crank attached to one end of said rod to turn said threaded rod;

securing means on each end of said threaded rod to hold said threaded rod in said first member;

lifting means attached to said end blocks of first member;

a second longitudinal rectagular member having the two ends located orthogonal to said first longitudinal rectangular member, said second member slidable positioned through a hole in said carriage;

locking means to prevent said second member from sliding in said carriage after being positioned;

lifting means attached to the bottom of each end of said second member;

adjusting means attached to the top of each of said second member;

adjusting locking means to hold said second member firmly in place whereby said object is tilted in said first plane by moving said carriage inside of said first member by said crank and said second member in said hole in said carriage to move the center of gravity of said object away from being concentric with said hoisting means.

2. A device as described in claim 1 wherein said first rectangular member and said second member is made from high strength steel.

3. A device as described in claim 1 wherein said carriage contains wheels which are captured inside of said frame by the edges of said frame being turned.

4. A device as described in claim 1 wherein said securing means on said crank end of said threaded rod is by attaching a thrust washer and lock nut to said threaded rod on the outside of said end block.

5. A device as described in claim 1 wherein said securing means on the end opposite said crank end is by attaching said thrust washer and said lock nut to said threaded rod on the outside of said end block.

6. A device as described in claim 1 wherein said lifting means of said first member are chains attached through holes in the bottom end of each end block to hold said object.

7. A device as described in claim 1 wherein said holding means is a set screw threaded into said carriage to hold firmly said second member.

8. A device as described in claim 1 wherein said hoisting means is a cable attached to each end of said second member.

9. A device as described in claim 1 wherein said hoisting means is a chain attached to each end of said second member.

10. A device as described in claim 1 wherein said lifting means of said second members are chains attached to the lower end of said second member to hold said object.

11. A device as described in claim 1 wherein said adjustment means is a pulley to allow the center of gravity of said object to be moved away from being concentric with said hoisting chain, said hoisting chain to provide means for translating said object upward or downward.

12. A device as described in claim 1 wherein said adjusting locking means is a friction type lock incorporated in said pulley to lock said pulley in a set position.

13. A device as described in claim 1 wherein a circular longitudinal member may be substituted for said second longitudinal rectangular member.

14. A device for lifting and tilting an object comprising:

a longitudinal rectangular frame having two ends, an open top, a closed bottom, and closed sides;

end blocks attached to each end of said frame with holes therethrough;

a moveable carriage having threads therethrough positioned inside of said frame;

a threaded rod having two ends extending through said threaded carriage and through said holes in said end blocks to move said carriage in said frame;

at least four wheels positioned on said movable carriage, said wheels captured inside of said frame by the top edge of said frame being turned inward;

a crank attached to one end of said threaded rod to turn said threaded rod;

a thrust washer and lock nut attached to the crank end of said threaded rod on the outside of said end block to hold said threaded rod in said frame;

a thrust washer and lock nut attached to the end opposite said crank end of said threaded rod on the outside of said end block to hold said threaded rod in said frame;

chains attached through holes in the bottom end of each end block to lift and hold said object;

hoisting means attached to the top of said carriage whereby said hoisting means may be used to translate said object upward or downward;

tilting means whereby moving said carriage inside of said rectangular frame by said crank moves the center of gravity of said object away from being concentric with said hoisting means.

* * * * *